United States Patent [19]

Burch

[11] 4,032,734

[45] June 28, 1977

[54] SNAP-ATING MECHANISMS

[75] Inventor: Hadley K. Burch, Pittsfield, Vt.

[73] Assignee: B/K Patent Development, Inc., Highland Park, Ill.

[22] Filed: May 16, 1975

[21] Appl. No.: 578,148

Related U.S. Application Data

[63] Continuation of Ser. No. 418,372, Nov. 23, 1973, abandoned, which is a continuation-in-part of Ser. No. 360,393, May 14, 1973, abandoned.

[52] U.S. Cl. ..... 200/67 DA; 200/288; 337/347

[51] Int. Cl.[2] ..... H01H 13/36

[58] Field of Search ..... 200/67 DA, 67 DB, 67 D, 200/67 R, 241, 288; 337/347, 349, 390, 391

[56] References Cited

UNITED STATES PATENTS

| | | | |
|---|---|---|---|
| 2,179,099 | 11/1939 | Nelson | 200/67 DA |
| 2,777,032 | 1/1957 | Burch | 200/67 DA |
| 2,788,419 | 4/1957 | Young | 200/67 D |
| 2,859,312 | 11/1968 | Dahlgren | 200/288 |
| 2,954,447 | 9/1960 | Bolesky et al. | 200/241 |
| 3,098,905 | 7/1963 | Anderson | 200/241 |
| 3,213,228 | 10/1965 | Burch et al. | 200/67 DA |
| 3,803,526 | 4/1974 | Andersen | 200/288 |

*Primary Examiner*—David Smith, Jr.

[57] ABSTRACT

A snap-acting switch using a planar blade of resilient sheet metal which is stressed to an unstable condition such that with suitable stop members it will occupy two positions of stability. When motivated the blade will snap from one of the positions of stability to the opposite one. A pair of stop members (one or both of which may be electrical contacts) cooperate with the blade alternately as the latter changes in position. The stop members are displaced laterally from each other across the width of a resilient portion of the blade at or near one end thereof and are thus non-coaxial. The switch is an improvement of the switches shown, for example, in U.S. Pat. No. 3,213,228, maintains high electrical contact pressure up to the point of snap, and exhibits little or no contact bounce.

10 Claims, 23 Drawing Figures

FIG. 13
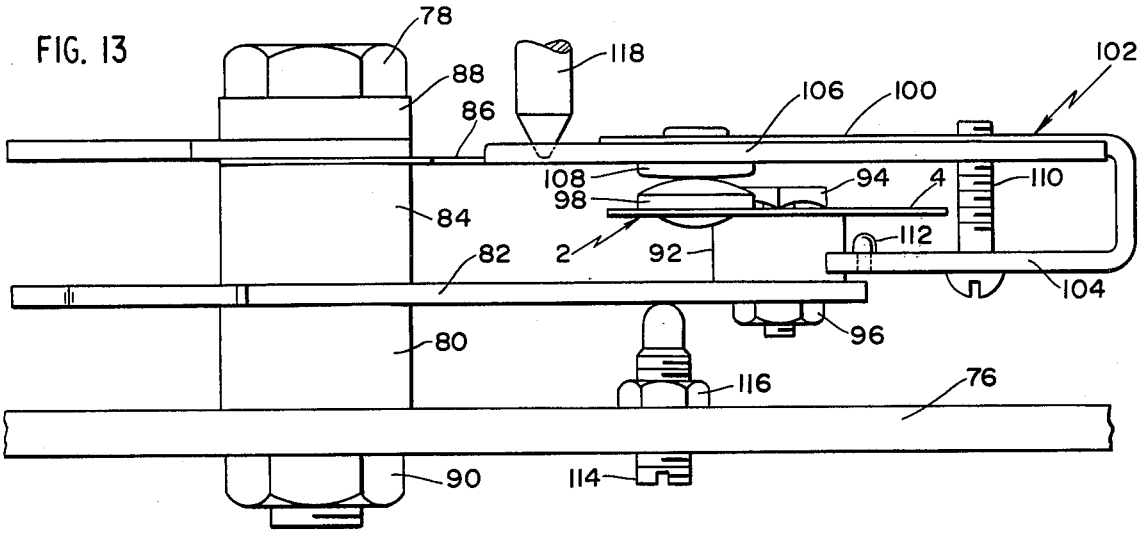
FIG. 14
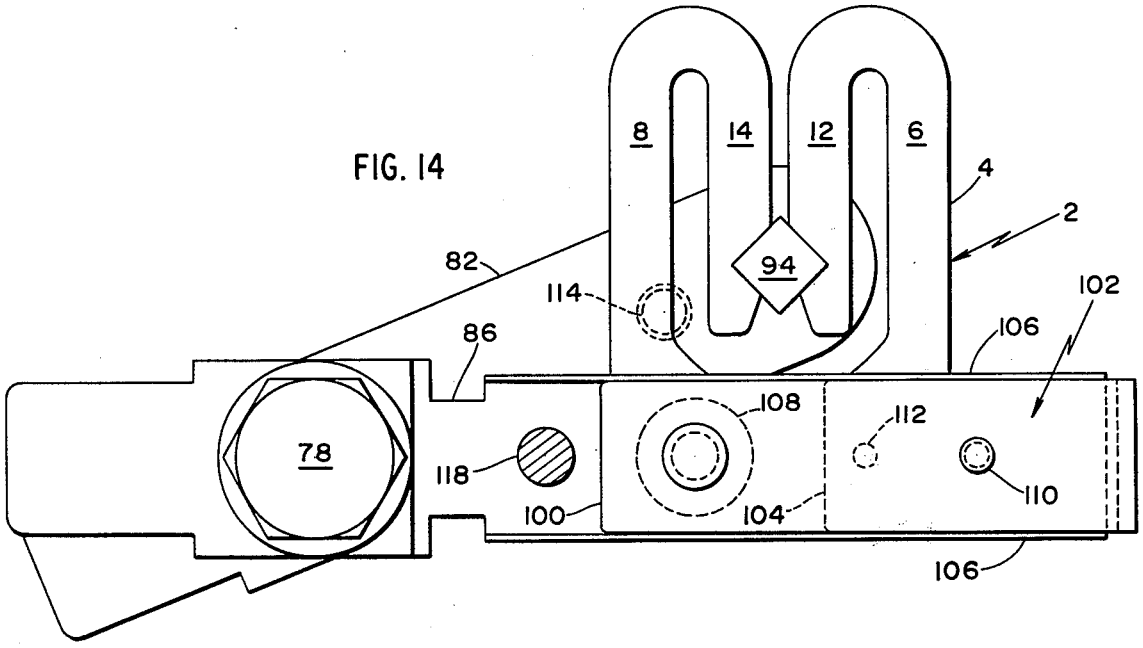
FIG. 15
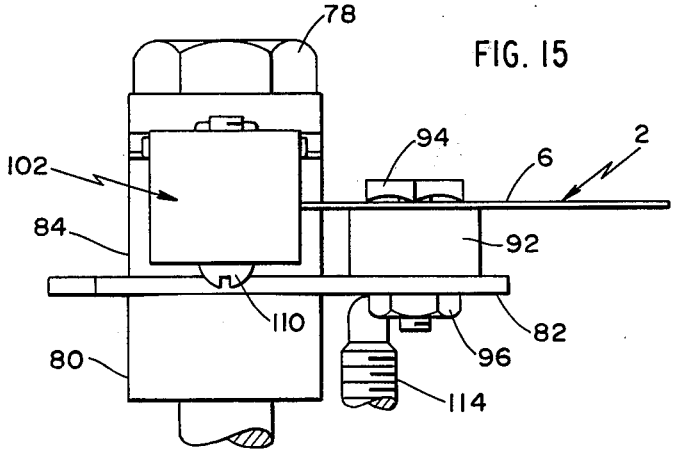
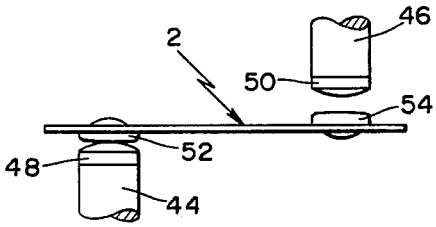
FIG. 16

SNAP-ATING MECHANISMS

This is a continuation, of application Ser. No. 418,372, filed Nov. 23, 1973 which is a continuation-in-part of U.S. patent application, Ser. No. 360,393, filed May 14, 1973, Hadley K. Burch inventor. Both applications are abandoned.

BACKGROUND OF THE INVENTION

The background of the invention is basically shown in the aforesaid U.S. Pat. No. 3,213,228 and in U.S. Pat. Nos. 2,179,099 (Nelson) and 2,777,032 (Burch) cited as references in U.S. Pat. No. 3,213,228.

U.S. Pat. No. 3,213,228 shows and describes a planar loop or blade of resilient sheet metal basically the same as that used in several embodiments in this invention. Briefly, it comprises two flat loops of generally U-shape, these loops being placed side by side. As so placed, the outer legs are longer than the inner legs, and the ends of the outer legs are joined by a cross-connection. The loop is stressed by spreading apart the inner legs, and as clearly described in that patent, the loop becomes unstable and occupies one of two stable positions. The thus stressed loop will snap with a snap action from one of these stable positions to the other stable position.

In the switch of U.S. Pat. No. 3,213,228 using this loop, the contacts are coaxial. Thus, the switch may be either a single pole, single-throw switch, or a single pole, double-throw switch.

Such a switch has desirable performance characteristics in regard to its motions, the force differentials required to operate it, and its snap action. However, in spite of the desirable results obtained by using the construction shown in U.S. Pat. No. 3,213,228, the invention thereof can be improved in certain respects by this invention.

Since prior art switches may be operated by relatively slowly moving means, the contact force being exerted by the snap-acting element decreases in such manner that, under some operating conditions, it will stay at or near zero value long enough to permit chattering of the switch contacts and possibly freezing thereof. There is, therefore, need of a snap-acting switch in which the contact pressure thereof, prior to actual contact separation, is maintained at a relatively high amount regardless of how slowly the operator actuates the switch.

In addition, in the snap closing of electrical contacts, bounce of the latter will generally occur. In many cases, such bouncing will cause freezing of the contacts and other deleterious effects. Therefore, there is need of a snap-acting switch in which simple and economic means are provided to minimize by several orders of magnitude the amount and duration of such bouncing.

SUMMARY OF THE INVENTION

It is therefore the general purpose of this invention to supply a snap-acting switch which answers the above needs, the invention providing switches in which the contact pressures are maintained at unexpectedly high levels up to the actual time of contact separation. The switches of this invention also provide for relatively small amounts of motivation of the switch actuating element, a relatively large contact separation during contact opening, and a minimum of contact bounce during contact closing. Speaking generally, the result of this invention is a switch which, for a given size, has a large rupturing capacity with a minimum of creep and chattering of the contacts under all conditions, and which has small switch-actuation movement differentials.

Among the several objects and provisions of the invention may therefore be noted the following:

An object of the invention is the provision of a snap-acting switch which for its size has a minimum of loss of contact pressure during switch actuation.

Another object of the invention is the provision of a switch of the above kinds, in which the total motion of the movable contact during its contact opening phase, is greater for a given size of switch than in prior art devices of the same size.

Yet another object of the invention is the provision of a switch of any of the above kinds, in which the amount of contact-opening (both dynamic opening and static opening) is greater than in prior art switches for a given amount of motivation of the switch to cause contact separation.

Still another object of the invention is the provision of a snap-acting switch which may be made in "miniaturized" forms, but still have a high rupturing capacity and high electrical rating.

Another object of the invention is the provision of a switch of any of the above kinds which has less contact bounce than prior art snap-acting switches.

As to all of the above provisions and objects, a switch is provided which is relatively simple to construct, simple and easy to calibrate, and which has relatively long life.

Other objects and advantages of the invention will be in part obvious and in part described in the description which follows.

The invention accordingly comprises the elements and combinations of elements, features of construction, and arrangements of parts which will be exemplified in the structures hereinafter described, and the scope of the application of which will be indicated in the appended claims.

In the accompanying drawings, in which several of the various possible embodiments of the invention are illustrated:

FIG. 13 is an elevation of a fourth embodiment of the invention, the embodiment using the mounting screw of FIGS. 10–12 therein.

FIG. 14 is a plan view of the FIG. 13 embodiment.

FIG. 15 is an end view of the FIG. 13 embodiment.

FIG. 16 is a schematic end view of a snap-acting element of the invention and including electrical contacts, given to show the use of electrical contacts in all of the embodiments given above.

Similar reference characters indicate corresponding parts throughout the several views of the drawings. In the drawings, dimensions of certain of the parts as shown may have been modified and/or exaggerated for the purposes of clarity of illustration and understanding the invention.

Figure 1:
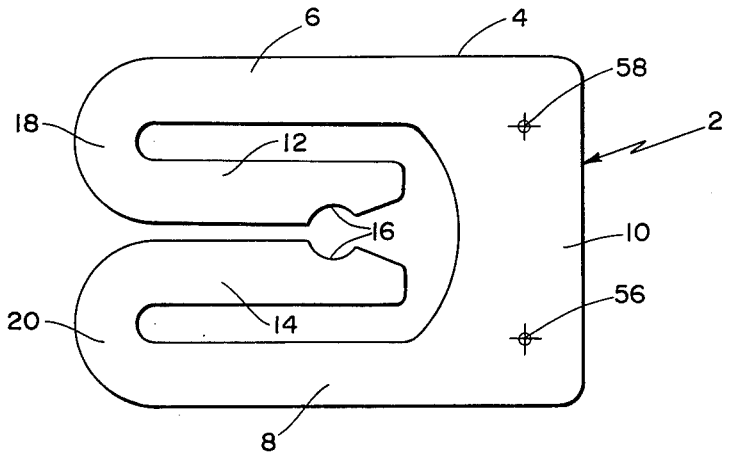
FIG. 1 is a plan view, enlarged, of the basic element or blade of a first embodiment of this invention.
Figure 2:
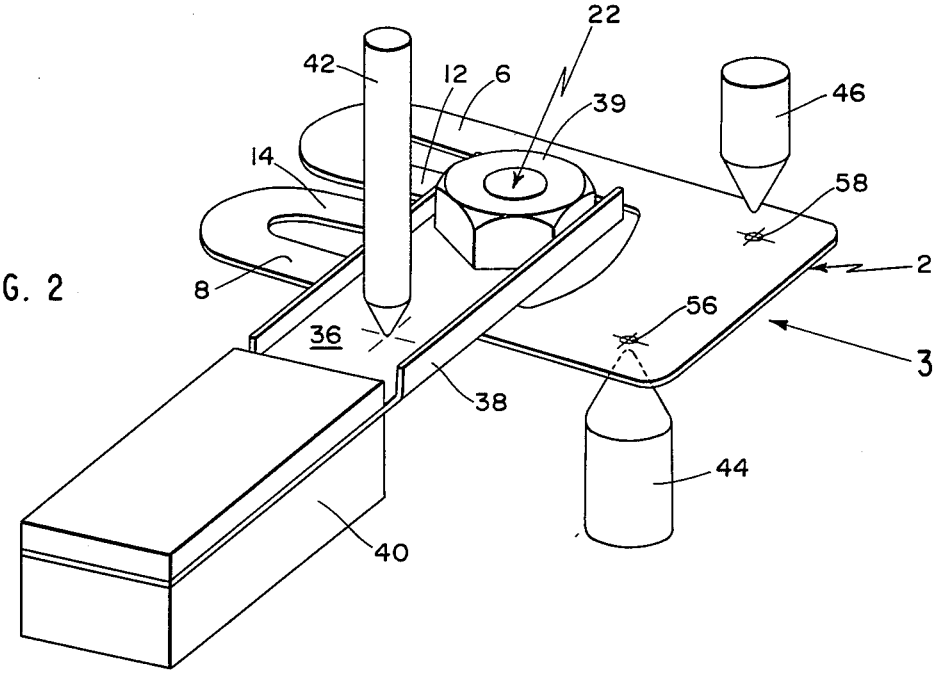
FIG. 2 is an illustration, somewhat schematic, showing the basic features of a first switch embodiment of this invention, the switch utilizing the FIG. 1 snap-acting sheet metal element.
Figure 3:
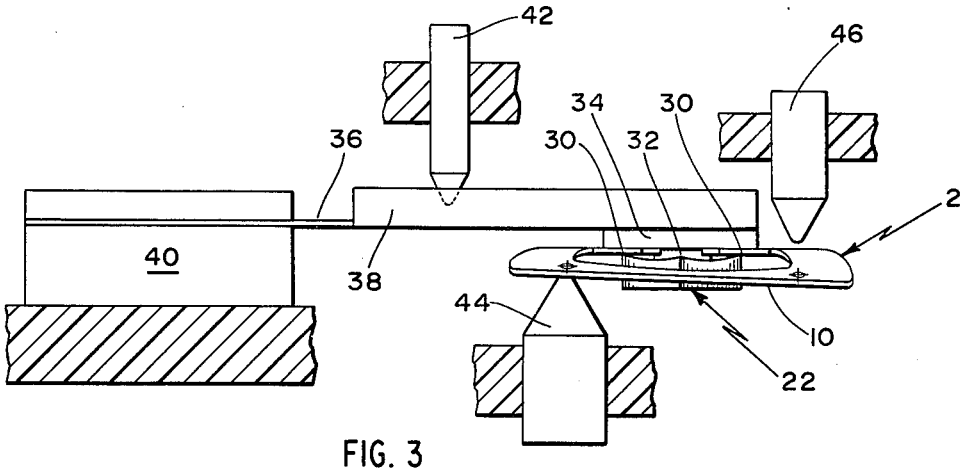
FIG. 3 is an elevation, taken in the direction of sight line 3 on FIG. 2.

Referring now to the drawings, and specifically to FIGS. 1, 2 and 3, one embodiment of the invention is shown. The embodiment is somewhat schematic, in that instead of showing actual electrical contacts, diagramatic stops are used either one or both of which can be electrical contacts, such as are shown in FIG. 16, for example. One or more of the electrical contacts may be stationary, and others may be fastened to the snap-acting element in order to make suitable engagement with stationary contacts. Details of the mounting base for the several operating members, and for the mounting of the cantilever spring which supports the snap-acting element, have been omitted for sake of clarity, and the guide means for the operator element (in this instance a push rod) operating the snap switches has also been omitted. The omitted details are to be found, if desired, in the aforesaid U.S. Pat. No. 3,213,228, the teachings of which are incorporated herein by reference, and will also be readily provided by persons skilled in the art.

FIG. 1 shows a plan view of a snap-acting element used in several embodiments of the invention indicated generally by numeral 2 of the kind generally shown, described and claimed in U.S. Pat. No. 3,213,228. The element comprises a sheet metal member 4 formed by securing one end of each of two distinct, coplanar and generally U-shaped loops, preferably, of resilient sheet material having their outer legs 6 and 8 joined by a resilient connector member 10. The shorter inner legs 12 and 14 of the loops are spaced apart a small distance as shown. Each inner leg is provided with a notch or semi-circular portion 16 as shown opposite each other, for facilitating mounting and stressing the element by these inner legs. The legs are joined by the semi-circular bight portions 18 and 20.

In use, and in accordance with the teaching of the aforesaid patent, the inner legs 12 and 14 are spread apart further than their normal unstressed position, and thus the entire element 4 becomes stressed so that it can and will snap from one of said positions to the other when force is applied at the proper locations. With the ends of the outer arms of the loops tied together as by portion 10, a stressing force can be applied in the plane of the strips by a single stressing means mounted between the inner arms, as will be described below. The blade has a longitudinal center line, and a transverse line passing through the point of blade mounting.

Referring to FIGS. 2 and 3, the snap-acting element 4 is mounted by a single mounting member 22 at the ends of the inner arms 12 and 14, utilizing the "hole" formed by the semi-circular portions 16 for that purpose. The diameter of the stud 22 itself where it passes through the hole, will be a predetermined amount larger than the diameter of the hole provided by the semi-circular sections 16, thus forcing the legs 12 and 14 apart the required amount.

Figure 10:
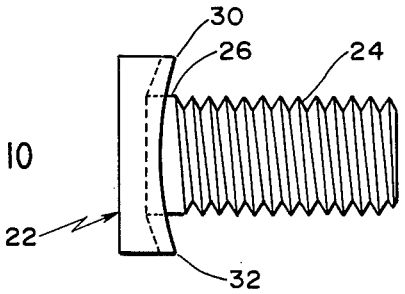
FIGS. 10, 11 and 12 are elevation, end, and sectional elevational views of a mounting screw useful in several of many of the embodiments of the invention.
Figure 11:
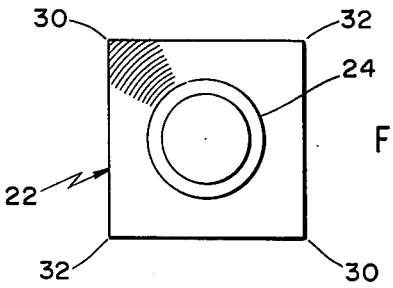
Figure 12:
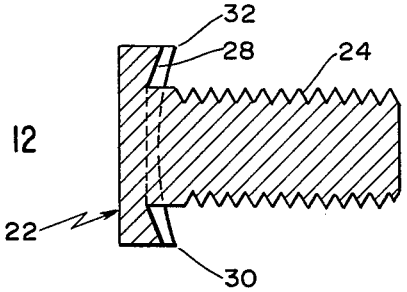

Referring to FIGS. 10–12, such a suitable mounting member or post 22 is shown, which has the effect of providing in a simple device the fulcrums preferable for insuring proper freedom of flexing of the inner legs and consequently the entire snap-acting sheet metal member to allow it to snap and to flex to realize this invention. The mounting post 22 is made from a piece of square stock, which can be, for example, mounted in a lathe for turning. Then using a properly shaped lathe tool, the shank 24 thereof is turned and threaded. As the cutting progresses, the end tool provides a smooth cylindrical hub surface 26, and the tool is so shaped that the end thereof projects inwardly at the proper angle to provide the concave depression 28. Since square stock is used, the result is that four bearing points 30 are provided relieved by the undercut 28. Such a structure can be conveniently made on automatic screw machines.

When mounting post 22 is used, two of the points 30 (which are diametrically opposite each other) will bear against the portions of the inner arms 12 and 14, and the other two points will fall within the slot between the inner arms. (See FIG. 14) Thus, blade 4 is mounted by means of a mounting post of simple and economical construction, and the element itself is given freedom to flex on the two points 30.

Mounting post 22 is passed through the hole 16, then through a washer 34, and through a suitable hole in a cantilever mounted spring arm 36. A lock nut 38 is used to clamp the element to the spring arm 36 by the aforesaid means.

It will be noted that in order to reduce the size of the switch, the arm 36 is cross-wise to the length of the snap-acting element 2. For some reason, unbeknownst to applicant at this time, a slightly better performance is obtained as compared to the second embodiment described below.

Spring arm 36 is made of spring sheet metal such as phosphor bronze or tempered beryllium copper, the phosphor bronze being preferred both for economy and also for its lower electrical resistance, since it conducts electrical current into the blade 4. Spring arm 36 is provided with upstanding sidewalls 38 to give rigidity to the forward half thereof and the rear half is mounted securely by conventional means to a block 40 at the necessary height above a base (not shown). Attachment of the spring arm 36 to the block 40 and the base is by conventional means, means for making electrical connection thereto also being provided.

Slidably mounted in the upper part of the switch enclosure is an operating member in the form of a cylindrical push rod 42, the end of which bears against the spring arm adjacent the end of the mounting block as shown.

Vertically above and below the connector portion 10 of element 2 are mounted, in upper and lower parts of the base, the "stop" members 44 and 46. For convenience of illustration, these members are shown as cylindrical members having ends 45 and 47 adjacent the blade 4. In most uses of the device, these "stop members" will be electrical contacts. For example, such a construction is shown in FIG. 16 in which electrical contacts 48 and 50 are mounted on stops 44 and 46, with cooperating contacts 52 and 54 being mounted on blade 4. Such construction (but not the location) is conventional for stationary contacts and no further description will be given here except to state that each of the supporting members for the contacts 48 and 50 are preferably made adjustable with respect to the blade 4. The cooperating electrical contacts 52, 54 are mounted in the end portion of the snap-acting blade 4, at the portions 56 and 58 and thus are co-axial with the respective fixed contacts 48 and 50.

The stop members 44 and 46 (and thus electrical stationary contacts if such are used) are so adjusted that their ends 45 and 47 lie in a pair of planes perpendicular to the direction of snap motion of connector 10, the planes lying below the level or height of the center or inner arms 12, 14 as shown. Since the blade is warped by the mounting member 22 so that the outer arms are flexed downwardly, connecting end portion 10 is positioned to bring the portion 56 on the blade in contact with the end 45 of stop 44. (Of course, if electrical contacts are used, the position of the blade would be that shown in FIG. 16 with the contacts 48 and 52 in contact.) This leaves the end 47 of stop member 46 out of engagement with the blade (and thus the contacts 50 and 54 separated). It is also to be noted that the position of the upper end of stop member 46 is below the level of the inner arms of the blade.

It is critical that the contacts of the device are non-coaxial, that is, contacts 48, 52 are non-coaxial with contacts 50, 54. That is, points 44, 56 are non-coaxial with points 46, 58.

Electrical current is conducted into and out of the switch via the spring arm 36, the center legs 12 and 14, the outer legs 6 and 8, the end 10, and the electrical contacts 48 and 52. The resulting switch will thus be single pole, single throw. If two sets of contacts are used, the blade becomes the common of a single pole, double-throw switch. The circuits are not shown in the drawings, since they are conventional.

If the actuator 42 is moved in a downward direction, in order to move the inner ends of the inner legs downwardly as viewed in FIG. 3, the result will be to stress the blade further, and move the inner legs to the point of instability of the blade, (ie., to a so-called neutral or "snap-over" plane), at which point the end 10 of the blade will snap in an upward direction (as viewed in the drawings) and bring the point 58 in contact with the pointed end 47 of stop 46, or bring electrical contact 54 in contact with the electrical contact 50. At the same time, the blade leaves the pointed end of the stop 44, that is, the contact 52 leaves contact 48.

It is important to note two features of the operation of the element as follows:

First of all, when the element snaps, there is no hindrance to the motion upwards of the portion 56 of the blade 4 except the natural resiliency and restraint of the blade itself. As a result of this, the portion 56 of the blade will "overthrow" to a distance further away from the stop member 44 than it will eventually occupy when the blade is at rest in this other position of stability. This additional movement is hereinafter called the dynamic motion of the blade, or the dynamic contact gap. After this overthrow of the blade has taken place, then the blade will come to rest in a position of stability (as long as the push member is held in a downward direction) with the portion 56 of the blade separated from the stop 44 by a given distance which is less than the dynamic gap. This is called the static contact gap.

Additionally, and this is important, it will be observed that as the push rod 42 is moved in a downwardly direction to cause snapping of the blade 4, the portion 58 on the other side of the blade gradually moves toward the end of stop member 46. That is, where contacts are used, contact 54 gradually and continuously moves towards contact 50. However, portion 58 does not make contact with the end of stop member 46 (and electrical contact 54 does not come into engagement with contact 50) until after the blade has snapped and has opened the engagement between stop member 44 and portion 56 of the blade. That is, contacts 50 and 54 do not close until contacts 48 and 52 have opened. As a result of this, it will be observed that prior to any snap action which causes contacts 50, 54 to make engagement, the blade itself has only a very small distance to move with a snap action to bring contacts 50, 54 into contact with each other. As a result of this, little velocity (and thus little momentum) is built up in the respective portions or contacts, and the switch in operation shows almost zero contact bounce. Bounce is present in most cases, but lasts a time in the order of four magnitudes less than what is experienced in conventional snap-acting switches.

This is unusual for snap-acting switches, and the applicant has no explanation for this phenomenon except to feel that it is due to the ability of the blade, when used in the manner aforesaid, to twist and flex about an axis parallel to the longitudinal center line or axis of the blade 4, as well as snap back and forth when properly positioned and stressed in a switch. Thus the blade is able almost to close the open contacts prior to a snap-closing thereof. Its importance is to be realized in view of the fact that most freezing of the contacts of snap-acting switches occurs due to bouncing of the movable contact on a contact closing motion. With minimal contact bounce, the chance of contact freezing is greatly lessened.

In respect to the ability of the blade 2 to twist about its longitudinal axis, this twisting is greatly facilitated by the flexibility of the connector portion 10 near the ends of which are the points 56, 58 which cooperate with stops 44 and 46. This flexibility permits each of the arms 6 and 8 to twist slightly about an axis extending along the arm. The connector 10 can thus be considered as a laterally extending flexible arm at whose ends are mounted the contacts of the switch, the arm being movable toward and away from stationary contacts by the action of arms 6, 8, 12 and 14 while also being permitted to flex about said longitudinal axis.

With the blade 4 then in the position that contacts 50–54 are closed, if the actuator 42 is now released, the center arms of the blade are allowed to move upwardly, with the result that eventually an unstable position of the blade is arrived at, and the latter snaps back to the position shown in FIGS. 2 and 3. During this motion, it will be observed that just as happened in respect to contacts 50 and 54, the contacts 48 and 52 creep toward each other until just before snapping of the whole blade takes place. Again, as a result of this, the blade has little momentum insofar as the portion thereof mounting the contact 52 is concerned, and little or no bounce is observed when the contacts 48 and 52 engage.

Figure 4:
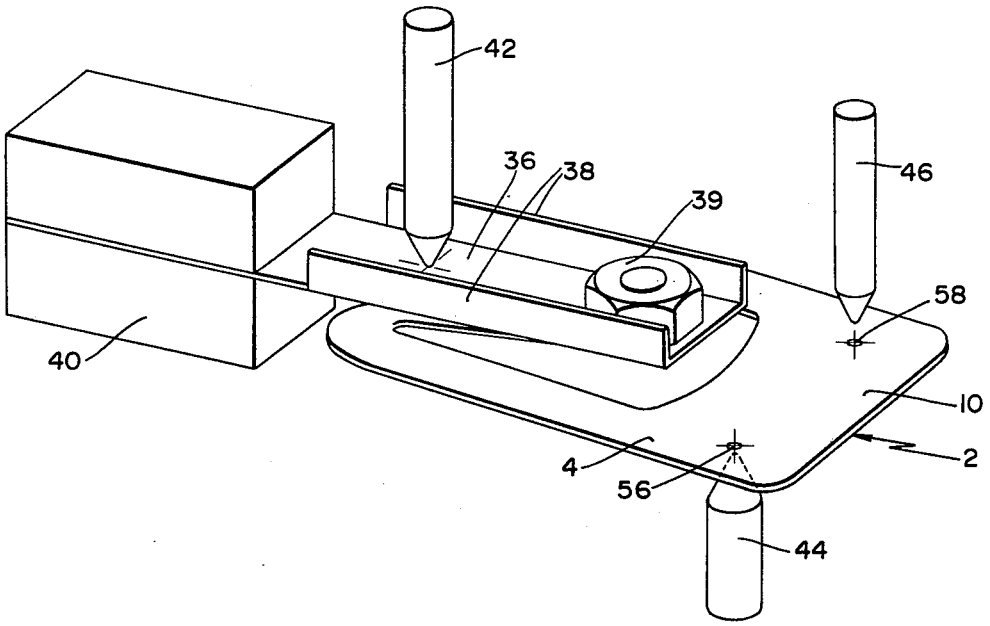
FIG. 4 is an illustration, in perspective, somewhat schematic, of a second embodiment of the invention, utilizing the same basic features and elements of the FIGS. 1–3 embodiment.
Figure 5:
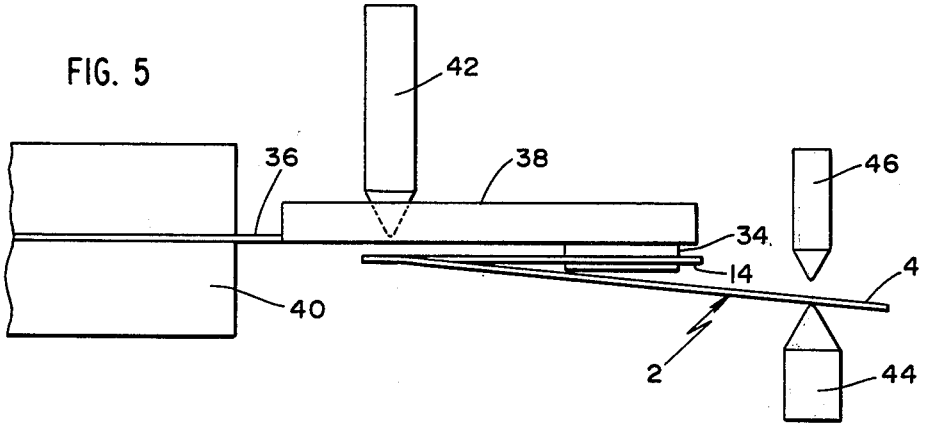
FIG. 5 is an elevation of the FIG. 4 embodiment, showing the snap-acting element in one position thereof.
Figure 6:
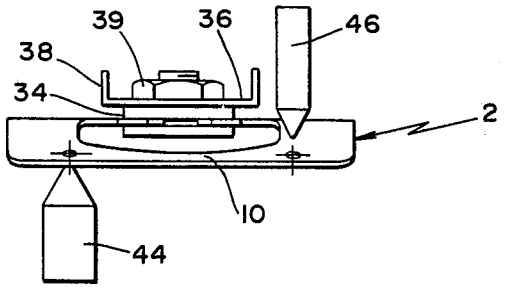
FIG. 6 is an end view of the FIG. 4 embodiment, given to clarify certain features of the invention.

Referring now to FIGS. 4, 5 and 6, a second embodiment of the invention is shown. Basically, it is the same as the first embodiment, except that the snap acting element or blade 4 is mounted so that its length is parallel to the length of the supporting spring arm 36. Stop members 44 and 46 are used as in the first embodiment, and will be stationary adjustable electrical contacts, as shown in FIG. 16, when the device is used as a switch. Corresponding contacts 54 and 52 will be mounted on the blade in the end zone 10 preferably at portions 56 and 58, but the electrical contacts (and of course their mating stationary contacts) may be placed elsewhere on the blade as will be described below more fully. Adjustment of the physical properties of the snap-acting switch will be made as set forth with respect to the FIG. 1 embodiment: that is, by shifting the gap between the parallel planes defining the ends of the stationary contacts 44 and 46 upwardly or downwardly with respect to the plane of the unstressed element center legs 12 and 14, and by changing the amount of said gap, the actuating forces and contact forces of the element can be changed in order to meet the desired specifications.

It is to be realized that certain of the physical constants of the embodiments of this invention will be established as is well known in the prior art, by changing the thickness of the snap acting blade 4, by charging its dimensions, and also by changing the spring characteristics of the spring member 36 and the position of the actuating member 42. In view of the infinite choices available as to the thicknesses of the various materials used, their width and length, their spring rates, and the relative width and length of the legs of the element, further details are not presented herein. Such matters can be easily determined by the person skilled in the art by utilizing the teachings herein. However, there will be provided below, as a guide, the dimensions of an operative switch embodiment made and tested satisfactorily.

Figure 7:
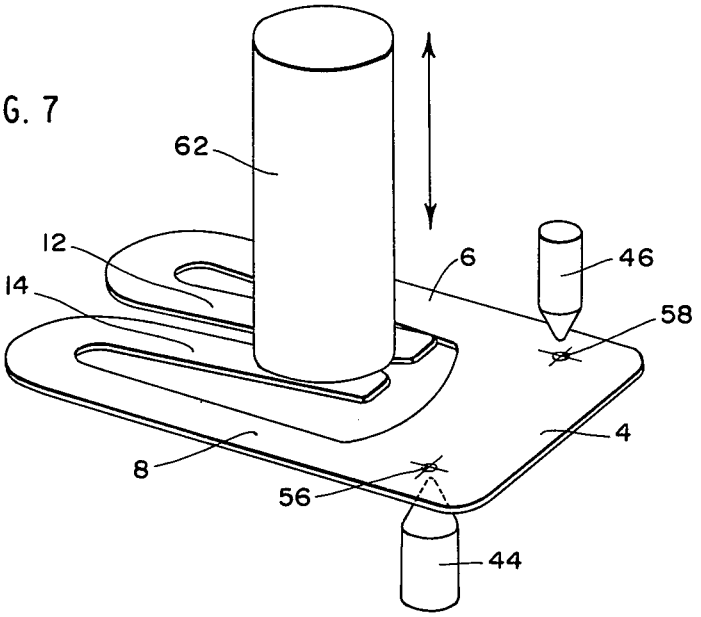
FIG. 7 is a perspective, somewhat schematic, view of a third embodiment of the invention, utilizing a different mounting structure for the snap-acting element thereof.
Figure 8:
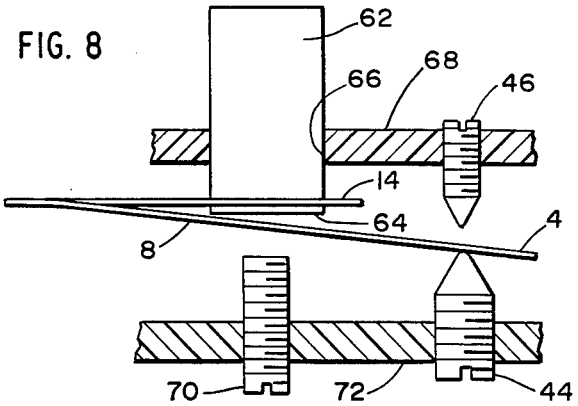
FIG. 8 is an elevation of the FIG. 7 embodiment.
Figure 9:
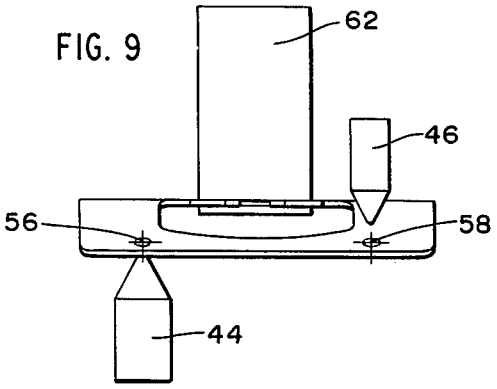
FIG. 9 is an end view of the FIG. 7 embodiment.

Referring now to FIGS. 7–9, a third embodiment of the invention is shown, in which the blade 4 of the prior embodiments is also used, and also the stationary stop members 44 and 46. (As before, the stop members will normally constitute electrical contacts 48, 50 with corrresponding contacts 52, 54 attached to blade 4.) In this embodiment, the blade is not mounted on a spring arm for actuation. Instead, an actuator 62 (which may conveniently be a cylindrical button) has a flat end to which the blade is clamped by a threaded mounting stud 64, the latter passing through hole 16 and spreading apart the inner legs 12 and 14 of the blade, as does the shank 26 of stud 22, thus stressing the blade the proper amount.

Actuator 62 may be slidably mounted in a conventional bushing or bore 66 in the upper housing 68 of the switch which is electrically insulating material such as molded synthetic plastic. A stop member 70 is threadably engaged in the base 72 of the structure to underly the actuator, and is adjusted so that when the latter has been pushed downwardly (as viewed in FIG. 8) sufficiently to snap the blade 4 from the position shown in FIG. 8 to the upper position where the blade engages stop member 46 (or contact 54 engages contact 50), further motion of the actuator will be prevented. Base 73 is also made of electrically insulating material. As in the previous embodiments stop members or contacts 44 and 46 may conveniently be threadably inserted into the base and housing as illustrated, for purposes of adjustment.

Referring now to FIGS. 13–15 for a fourth embodiment of the invention, a base 76 of electrically insulating material is shown on which is mounted, by means of mounting screw 78, an electrical insulating collar or bushing 80, a stiff but bendable support arm 82 made of an electrically conducting spring material such as phosphor bronze, a second electrically insulating collar or bushing 84, a spring arm 86 made of electrically conducting flexible material such as phosphor bronze, and an insulating collar 88. A lock nut 90 is used to hold the parts in their assembled relationship. If desired, a rivet construction may be used instead of the screw and nut assembly 78, 90. Suitable insulation surrounds screw 78 to insulate the arms from each other.

Arm 82 serves the dual function of being a supporting member for the snap-acting blade element 4 which is like the blade 4 of FIG. 1. The other function of the arm 82 is to act as an electrical current carrying arm. Blade 4 is fastened to the end of arm 82 by means of a mounting member 94 like member 22 shown in FIGS. 10–12. A metal sleeve or collar 92 is provided beneath the center arms 12 and 14, through which passes the mounting screw. The shank of the mounting screw is made sufficiently large, as in the previous embodiments, to force the inner legs 12 and 14 apart to stress the snap-acting blade 4. A fastening nut 96 is provided to clamp the blade to the collar 92 and thus to the arm 82 in electrical contact therewith. An electrical contact 98 is fastened either by welding or riveting to the end of the blade, as shown, in an optimum position such as 56.

For a portion of its length, spring arm 86 is provided with side walls 106 for stiffness, and lying therewithin and attached thereto is the upper arm 100 of a U-shaped element 102 having also a shorter lower arm 104. Fastening of the upper arm to the spring blade 86 may be conveniently done by using a rivet type electrical contact 108 positioned to mate with the electrical contact 98, the stem of the contact serving to act as a rivet to hold the end of said upper arm to the spring arm 86 as well as electrically engaging arm 86. Further holding is accomplished by providing a threaded hole in the upper arm 100 through which passes the threaded shank of an adjusting screw 110, the shank slidably passing through suitably provided hole in the lower arm 104 as shown. Mounted at the end of the shorter arm 104 is an electrically insulating stop member 112, this being conveniently made of a synthetic resin or a ceramic material, and conventionally fastened to the end of the arm 104.

Threadably engaging the base 76 is the adjusting screw 114, the adjusted position thereof being held by means of the lock nut 116. The upper end of the adjusting screw bears against the flexible mounting arm 82 as shown.

An actuating member 118 like that of the FIG. 1 embodiment is provided and suitably slides through a supporting hole or bushing in the cover of the switch (not shown).

It will be noted that in this fourth embodiment, the blade is not snapped by applying the actuating element directly to the center legs of the blade, as in the previous embodiments. Instead, actuator 118 moves spring arm downwardly (as viewed) which moves contact 108 downwardly. Downward motion of contact 108 moves contact 98 downwardly, and this flexes the outer legs of the blade toward the plane of the center legs until a point of instability is reached. The blade then snaps to separate contacts 98 and 108, and the other side of the blade end comes to rest against stop 112. The arm 82 is sufficiently rigid or stiff so that during this operation, the mounted portion of the center legs remains stationary.

When the spring arm 86 is deflected downwardly, the U-shaped supporting arm 102 moves downwardly with it, so that stop 112 also moves downwardly. As a result, when actuator 118 is released to move upwardly so that the spring arm 86 moves upwardly, the latter moves stop member 112 upwardly. This exerts a force against the end of the snap-acting blade to move it upwardly until an unstable position is again reached, and now the blade will snap back into the position shown in FIG. 13. In so moving, and as the actuator element 118 is gradually released, it will be observed that the contact 98 will "creep" in a direction toward the contact 118 which is moving upwardly with it. However, the upward motion of the stop 112 is greater than the motion of contact 108, so that any gap between these two contacts gradually closes. Just prior to actual closing taking place by means of such creep action, the blade will have reached its unstable position, and then contact 98 will close against contact 108 with a snap action. Due to the small distance that contact 98 must move during the snap motion against contact 108, contact 98 will have little momentum, and thus contact bounce will be zero or minimal at the most.

In order to adjust the actuator movement differential of the device, actuator 118 is moved downwardly to the point that the blade snaps. Then the actuator is slowly moved upwardly an amount equal to the motion differential required. At that point, further upward motion of the actuator 118 is stopped, and the adjusting screw 110 is turned to bring the stop member 112 (and the blade which is resting against it) upwardly until the blade now snaps to bring the contacts 98 and 108 into an engagement. Due to the resilience of the U-shaped arm 100, the adjusting screw 110 will generally stay in its adjusted position. However, if it is desired, a locknut (not shown) may be provided at its upper end.

The force differential of the device may be adjusted by utilization of the adjusting screw 114. The further arm 82 is moved upwardly (as viewed in FIG. 13), the smaller the force that is required to actuate the device, and vice versa.

Of course, the above differential is a function of the position of the support arm 82 and thus the position of the blade 4 with respect to the stationary contact 108. As a result, if the adjusting screw 114 is moved in a downwardly direction (as viewed in FIG. 13) so as to move the blade itself downwardly, then a longer throw of the actuating element 118 will be needed in order to cause the blade to snap downwardly to its opposite position at which it comes to rest against the stop 112. Correspondingly, a greater movement upwardly of the actuator 118 causes the blade to re-snap back into its upper position under the influence of stop member 112 which pushes the blade upwardly.

In the FIGS. 4–6 construction, by way of example, the spring contact arm may be, for example, 0.01 inch thick tempered beryllium copper material. The blade 4 itself may be made of similar material, and will be, for example, 0.550 inches in total width, 0.830 inches in total length. The distance from the center of the hole provided at the inner edges of the center legs for mounting, to the rear end of the element will be approximately 0.421 inches, and the distance from said center of the hole 16 to a line joining the points 56, 58 will be approximately 0.312 inches. The points 56, 58 (and thus the centers of contact 98 and stop 112) will be approximately 0.170 inches from the longitudinal center line of the blade 4.

The above dimensions may also be conveniently followed for all of the prior embodiments. (In FIGS. 1–3, the actuator member 42 is approximately 0.375 inches from the center of the hole 16.) In the embodiments shown in FIGS. 13–15, the dimensions of the snap blade are the same as for the FIG. 1 embodiment, and the electrical contact 98 and the stop 112 are positioned at the points 56, 58 as shown in the FIG. 1 embodiment. The actuator element 118 is approximately 0.360 inches from the center of post 78 and approximately 0.250 inches from the center of the rivet type contact 108. The centers of contact 98 and stop 112 are approximately 0.145 inches from the longitudinal center line of the blade 4. The length of the flexible portion of the arm 86 (ie., the portion not having side walls 106) from the perimeter of the collar 88 is approximately 0.173 inches.

Two points are to be emphasized in regard to the switch of this invention as compared to the switch of the prior art devices, as well as the switch and device shown in U.S. Pat. No. 3,213,228.

In the prior art snap-acting devices, it will be noted in general that as the actuating element of the switch is moved to cause the snap-acting element to snap, the force or pressure between contacts decreases at a fairly steady rate until just before snap action takes place. At this point, insofar as those switches are concerned which applicant has tested, the residual contact force remaining just before a snap break takes place is less than 2 grams. In contrast, in the switches of the instant device, the residual force that is left (that is, the force holding the contacts together) just before the contacts separate, can be adjusted to be greater than 25 grams. This is greater by an order of magnitude of ten times or more than that which is found in the prior art snap-acting switches. That is, a better than 1,000% improvement. As a result, the devices of the above devices have far less tendency to chatter than do the prior art devices.

The other point to be emphasized relates to contact bounce. In devices in which the snap-acting elements are not relatively free to twist and flex as is the case in the instant invention, and since in such prior art switches the respective contacts are mounted coaxially, it is found that no motion of a movable contact takes place (that is, no contact separation takes place) until the snap action actually occurs. As a result, the movable contact builds up a relatively high velocity as it moves through the contact gap and finally strikes the other contact at the other end of its snap motion. The result of this is that the contact itself has a relatively high momentum, and due to the general elasticity of the structures including the contact materials, the moving contact bounces. Oftentimes, the result of this is that the contacts "freeze", thus making the switch inoperative. On the contrary, in the instant invention, the contact which is to move with a snap action to a contact-closed position, is caused to move gradually toward that position during motion of the switch actuator, until just prior to making engagement with the stationary contact to close a circuit. (By just prior is meant a distance of only a few thousandths of an inch.) As a result, when snap action takes place, there is little distance left for the contact to move through, and in traversing this small distance with a snap action to engage the stationary contact, little momentum builds up. As a result, little or no contact bounce is experienced as contrasted to prior art switches.

As to embodiments using the blade 4 of FIG. 1, it has been found that for most switch purposes, optimum performance results when the contacts 52 and 54 are mounted on the blade 2 approximately the points indicated by numerals 56 and 58. However, unexpected improvements resulting from the invention over prior art switches are also obtained if the electrical contacts 52, 54 are mounted anywhere in the respective portions of the blade defined by a longitudinal center line passing through the mounting post, the edge of the element, a transverse line passing through the mounting post, and the outer end edge of the connector 10.

The above descriptions are for embodiments in which the snap-acting blades return to the positions shown when force is released from the actuator buttons. To effectuate this, the upper stop (as viewed in all cases) must be below the plane the center legs will occupy prior to stressing. However, if it is desired to have the snap-acting blade remain in each of the upper positions or lower positions after being actuated, all that is necessary is to have the lower end of the upper stop (e.g. stop 46) above said center leg plane, and the upper end of the other stop (e.g. stop 44) below said plane.

In all embodiments, because of the non-coaxial location of the stops 44 and 46, (or corresponding electrical contacts 48 and 50), when the blade snaps there is no stop member preventing free springing of the blade portion (such as portion 56) beyond its eventual at-rest position. This over-throw or free springing results in a very large momentary contact separation when the small size of the switch is considered, thus increasing the rupture capacity of the device when used as a switch.

Throughout the description and in the claims, where reference is made to a snap-acting blade or element having two positions of stability, the phrase covers all embodiments shown and described as well as that described above wherein the blade will remain at rest at each stop until actually motivated by a force applied thereto by the actuator.

A typical switch such as that shown in the FIGS. 4–6 embodiment has been successfully constructed and tested, in accordance with the following, dimensions, forces and other measurements being approximate.

| | |
|---|---|
| Blade thickness | 0.010 inches |
| Blade width | 0.550 inches |
| Blade material | Full hard beryllium copper |
| Width of outer legs | 0.100 inches |
| Width of inner legs | 0.100 inches |
| Distance apart of plane defining separation of ends of stationary stops | 0.014 inches |
| For automatic return blade, distance of ends of stops 44 and 46 from center plane of inner legs | 0.064 inches and 0.078 inches, respectively |
| Distance from center mount to line joining stops | 0.200 inches |
| Distance of each stop from longitudinal center line | 0.210 inches |
| Distance of center mount from point of support (or hinge point) of spring arm | 0.625 inches |
| Distance of actuator element from said support or hinge point | 0.250 inches |
| Length of non-stiffened portion of spring arm | 0.0625 inches |
| Width of spring arm | 0.250 inches |
| Spring arm material | Same as snap-acting blade |
| Actuating force | 420 grams |
| Release force | 315 grams |
| Force differential | 105 grams |
| Force holding contacts together when actuator has moved center leg to within 0.000025 inches of snap position | Over 15 grams |

Figure 17:
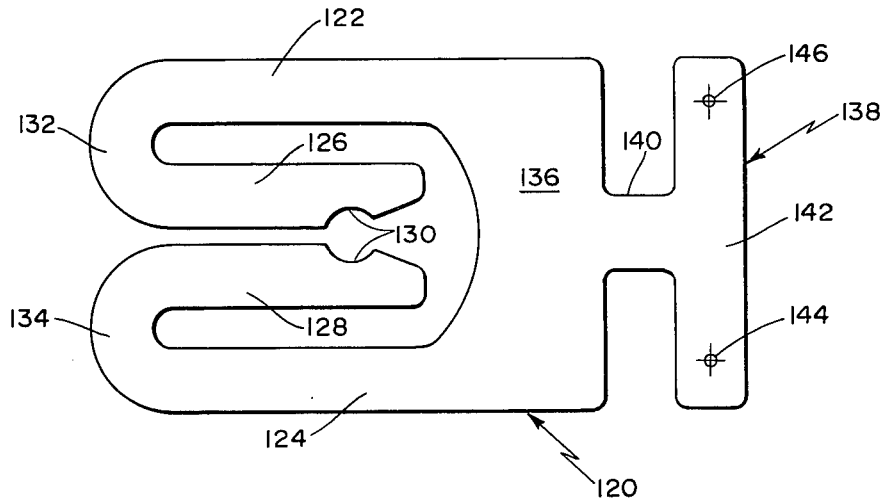
FIG. 17 is a plan view, enlarged, of the basic element or blade of a fifth embodiment of the invention.
Figure 18:
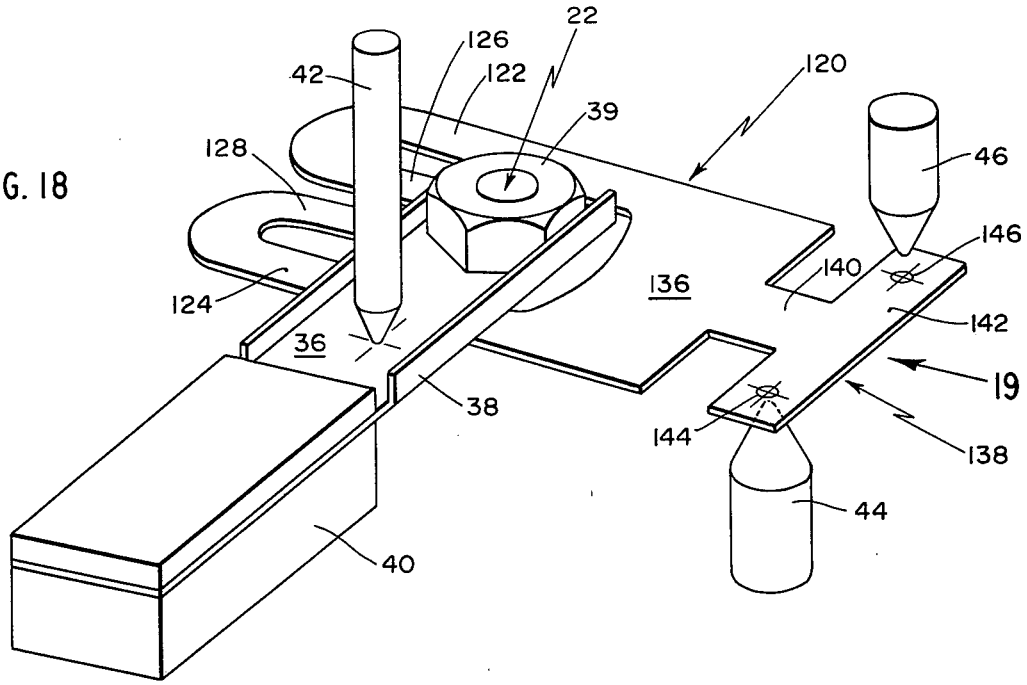
FIG. 18 is an illustration, somewhat schematic, showing the basic features of the fifth switch embodiment of this invention, the switch utilizing the FIG. 17 blade strained or stressed to be snap-acting.
Figure 19:
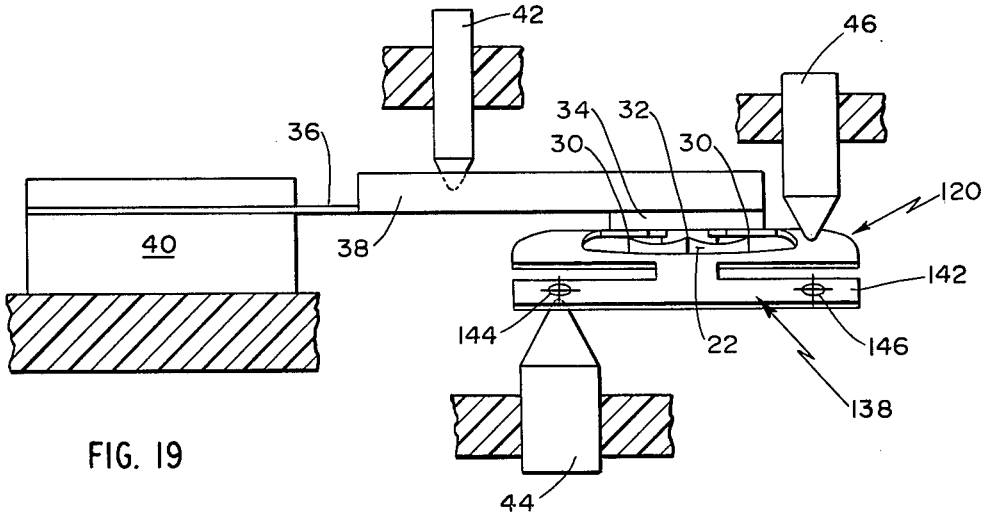
Figure 20:
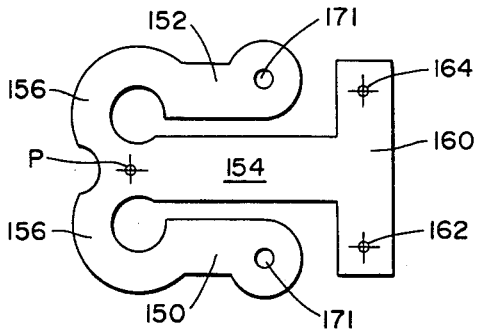
Figure 21:
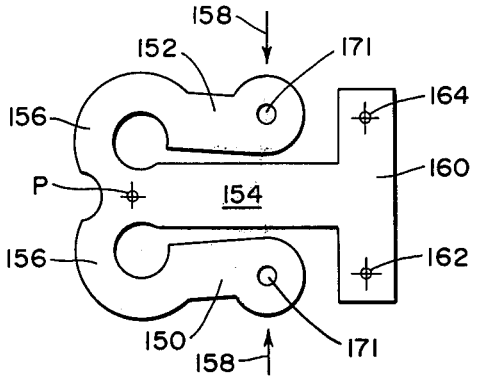
Figure 22:
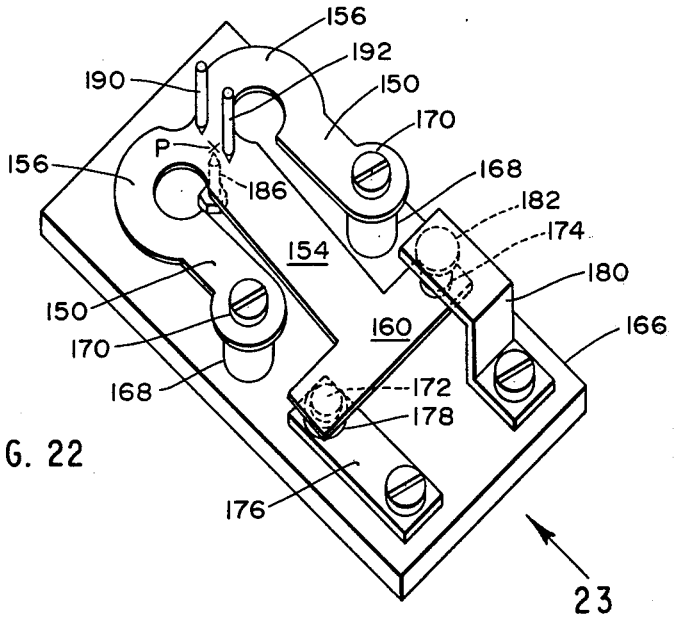
Figure 23:
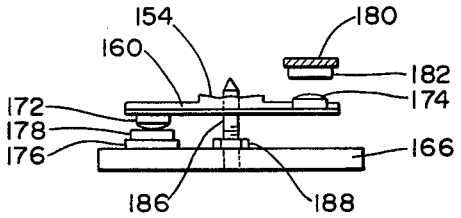

Referring now to FIGS. 17–19, a fifth embodiment of the invention is shown, in which additional means are provided to increase the twisting and other movements of the blade to improve the non-bounce and non-chatter characteristics of the device. A blade 120 is shown having the general characteristics of blade 1 insofar as are concerned the outer arms 122 and 124, inner arms 126 and 128, mounting hole 130, the joining of the outer arms by the loops 132 and 134, and the connecting of other ends of the outer arms by the connecting member 136.

Joined to the connecting element 136, preferably by an integral extension thereof, is contact-carrying member 138 (indicated generally) of flexible sheet metal, the member constituting a relatively narrow neck 140 attached at one end to member 136 and terminating at its other end by the flexible sheet metal cross-member 142. The material of the additional element 138 is preferably the same as the material for the blade 120, and the width of the neck 140 and the cross arm 142 can be approximately the width of the arms 122.

Points 144 and 146 on member 142 correspond to points 56 and 58 of blade 1. At these points, when the device is used as a switch, would preferably be attached electrical contacts such as the contacts 52 and 54 as shown in FIG. 16.

FIG. 18 shows an assembly of the blade of FIG. 17 in the manner shown in FIG. 2 of the first embodiment. The parts which are common to FIG. 18 and FIG. 2 bear the same numerals, that is, spring arm 36, reinforcing flanges 38 on arm 36, and the mounting blocks 40 are the same as in FIG. 2. The manual actuation member 42, mounting post 22, and nut 39 are the same as shown in FIG. 2.

Stationary stop members 44 and 46 are provided as in FIG. 2, these being located each respectively coaxial with the points 144 and 146. The adjustment of the stop members is the same as described for the previous embodiments, and by this means the force and movement differentials of the device may be adjusted.

FIG. 19 is an end view of the FIG. 18 illustration, given to show in greater clarity the arrangement of the respective parts. As indicated above, the device is properly adjusted by moving the stop members upwardly and downwardly with respect to the central or neutral plane of the blade, until the proper operational results are obtained.

In a switch constructed shown in FIGS. 17–19, and comparing the device with the switch of, for example, FIGS. 2–6, the contact force being exerted was 27 grams when the actuator 42 was moved downward to the point that it was 0.0001 inches away from the position at which the blade would snap to the other position. This compares to 23 grams under the same conditions for a standard blade. The static contact gap for the device of this switch was 0.312 inches as compared to 0.285 inches for a standard blade.

In the embodiment of FIGS. 17–19, it will be observed that as the actuator of the respective switch is moved in a direction to cause snap-action of the blade to open the closed contacts, the other contact on the blade will gradually move (creep) toward its stationary mating contact. However, it will not engage the latter until the blade actually snaps. When the latter does this, the distance between the open contacts is small, so that when the "open" contacts now close with a snap action, little or no bounce occurs.

In all of the above embodiments, conventional practices are to be followed in respect to making and using electrical insulating materials, such as for the bases and housing, the collars and sleeves where they are to provide electrical insulation, the actuator members, and so forth.

In view of the above it will be seen that the several objects of the invention are achieved and other advantageous results attained.

It is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

As many changes could be made in the above constructions without departing from the scope of the invention, it is intended that all matter contained in the above description or shown in the accompanying drawings, shall be interpreted as illustrative and not in a limiting sense, and it is also intended that the appended claims shall cover all such equivalent variations as come within the true spirit and scope of the invention.

Having described the invention, what is claimed is:

1. In a snap-acting mechanism comprising a snap-acting generally planar blade of resilient material including a pair of outer legs, a pair of inner legs extending between said outer legs, and connecting portions each connecting said legs into a unitary structure, said connecting portions defining, for each of said pairs of legs, an unstressed leg separation; means for maintaining one of said pairs of legs with a separation different from said unstressed separation, thereby to stress said blade and bias a portion thereof in a direction transverse to the plane of said blade; support means supporting the inner legs; and movable actuator means for causing the blade to snap from a first position of stability to a second position of stability;

the improvement comprising first fixed stop means on the support disposed to the side of the blade that is in the direction of actuating movement of said actuator means, and positioned to engage the blade when the latter is in its first position of stability but to be spaced apart from the blade when the latter is in its second position of stability;

second fixed stop means on the support non-coaxial with the first stop fixed stop means, disposed to the other side of the blade, and positioned to be spaced apart from the blade when the latter is in its first position of stability but engaging the blade when the latter is in its second position of stability.

2. The device of claim 1 in which said actuating means includes means for moving at least one of said inner legs relative to the plane of the outer legs in a direction toward said first fixed stop member and away from said second fixed stop member, to cause instability of the blade, the blade during such movement both flexing and twisting as it approaches the position of blade instability.

3. The device of claim 2 in which said flexing and twisting causes a blade portion adjacent said second fixed stop means, while said blade is in engagement with the first fixed stop means, to approach said second fixed stop means but not engage the latter until snap motion of the blade takes place, thereby to reduce the distance said blade portion moves with a snap motion toward said second fixed stop means.

4. The device of claim 1 in which said inner legs are connected to said outer legs by bights joining an end of an outer leg to an end of an inner leg.

5. The device of claim 4 in which said inner legs are held in spaced-apart relationship a distance greater than the inner legs would be when the blade is in an unstressed condition.

6. The device of claim 5 in which said support means comprise movable resilient means mounted on a base and supporting said inner legs.

7. The device of claim 6, in which said support means comprise a cantilever spring arm having one end portion mounted on a base, the snap-acting blade being carried by the other end portion of the spring arm.

8. The device of claim 7, in which said actuator means comprise a slidable push-button engagable said cantilever spring arm at a location intermediate said end portions.

9. The device of claim 7 in which said inner and outer legs are essentially at right angles to the cantilever spring arm.

10. The device of claim 1 in which said blade connecting portions include an arm of flexible metal extending crosswise of the blade and having end portions secured to free ends of said outer legs.

* * * * *